US008261736B1

(12) United States Patent
Olivarri

(10) Patent No.: US 8,261,736 B1
(45) Date of Patent: Sep. 11, 2012

(54) FIREPLACE COVER

(76) Inventor: Bobbie D. Olivarri, Hanover, MI (US)

( * ) Notice: Subject to any disclaimer, the term of this patent is extended or adjusted under 35 U.S.C. 154(b) by 409 days.

(21) Appl. No.: 12/417,545

(22) Filed: Apr. 2, 2009

(51) Int. Cl.
*F24B 1/192* (2006.01)
*E06B 9/521* (2006.01)

(52) U.S. Cl. ..... 126/547; 126/548; 126/545; 126/202; 160/327; 160/369; 40/606; 40/610

(58) Field of Classification Search ..... 126/545, 126/547, 202, 548; 160/327, 369; 40/606
See application file for complete search history.

(56) References Cited

U.S. PATENT DOCUMENTS 2,959,832 A * 11/1960 Baermann ..... 24/303
3,071,409 A * 1/1963 Gibson et al. ..... 297/45
3,111,728 A * 11/1963 Alderfer ..... 49/478.1
3,465,536 A * 9/1969 Hermanson et al. ..... 62/158
3,797,172 A * 3/1974 Cannon ..... 49/463
3,894,527 A * 7/1975 Ickes ..... 126/545
4,072,140 A 2/1978 Gallagher
D267,972 S 2/1983 Schockemoehl et al.
4,775,182 A * 10/1988 von Hoffman ..... 297/45
5,083,390 A * 1/1992 Edman ..... 40/607.02
5,099,590 A * 3/1992 Yamaguchi ..... 40/711
D328,531 S * 8/1992 Citterio ..... D6/372
5,301,655 A 4/1994 Licata
5,671,967 A * 9/1997 Gurganus et al. ..... 296/146.9
6,073,625 A * 6/2000 Ball ..... 126/547
6,748,943 B1 * 6/2004 Krimmer ..... 126/547

* cited by examiner

*Primary Examiner* — Steven B McAllister
*Assistant Examiner* — Nikhil Mashruwala

(57) ABSTRACT

A fireplace cover comprising a generally flat and flexible panel; a first slot disposed in the panel along the first side edge, wherein the first slot is adapted for receiving a removable first magnetic bar; a second slot disposed in the panel along the second side edge, wherein the second slot is adapted for receiving a removable second magnetic bar; a third slot disposed in the panel along the top edge, wherein the third slot is adapted for receiving a third magnetic bar; and a fourth slot disposed in the panel along the bottom edge, wherein the fourth slot is adapted for receiving a fourth magnetic bar.

3 Claims, 5 Drawing Sheets

FIREPLACE COVER

FIELD OF THE INVENTION

The present invention is directed to a device for covering a fireplace, more particularly to a kit comprising a decorative device for covering a fireplace via a magnetic mechanism.

BACKGROUND OF THE INVENTION

Fireplaces may become unsightly if they are not cleaned regularly or if remaining ash is not removed. Additionally, homeowners may wish to cover their fireplace in an effort to enhance aesthetic appeal of their living space. Fireplaces may also be a source of drafts in a home. The present invention features a fireplace cover for covering a fireplace. The fireplace cover can help hide the fireplace as well as provide a decoration to the home.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
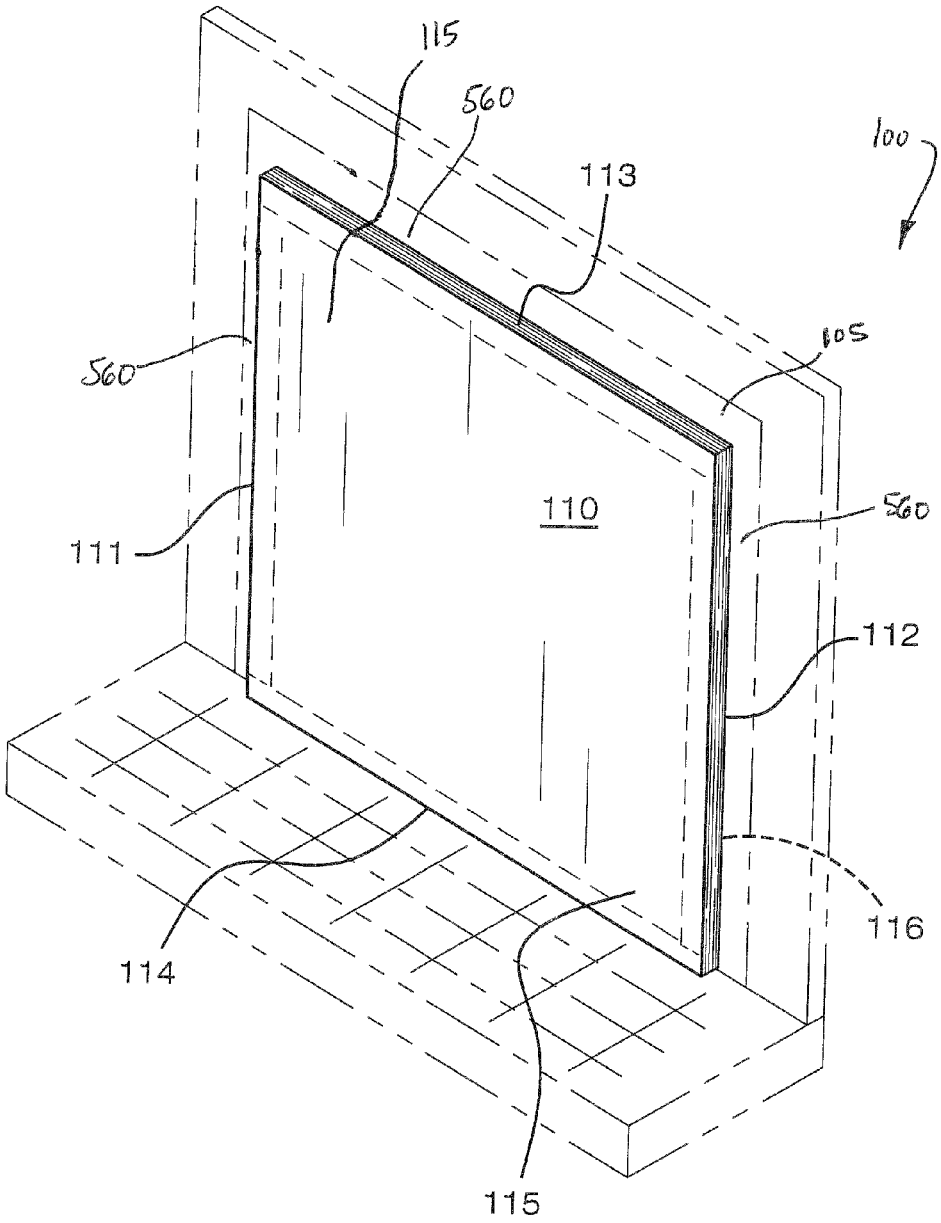
FIG. 1 is a perspective view of the fireplace cover of the present invention.

The following is a listing of numbers corresponding to a particular element refer to herein:

100 fireplace cover
105 fireplace
110 panel
111 first side edge of panel
112 second side edge of panel
113 top edge of panel
114 bottom edge of panel
115 front surface of panel
116 back surface of panel
210 first slot
211 first end of first slot
212 second end of first slot
220 second slot
221 first end of second slot
222 second end of second slot
230 third slot
231 first end of third slot
232 second end of third slot
240 fourth slot
241 first end of fourth slot
242 second end of fourth slot
310 first magnetic bar
320 third magnetic bar

Figure 2:
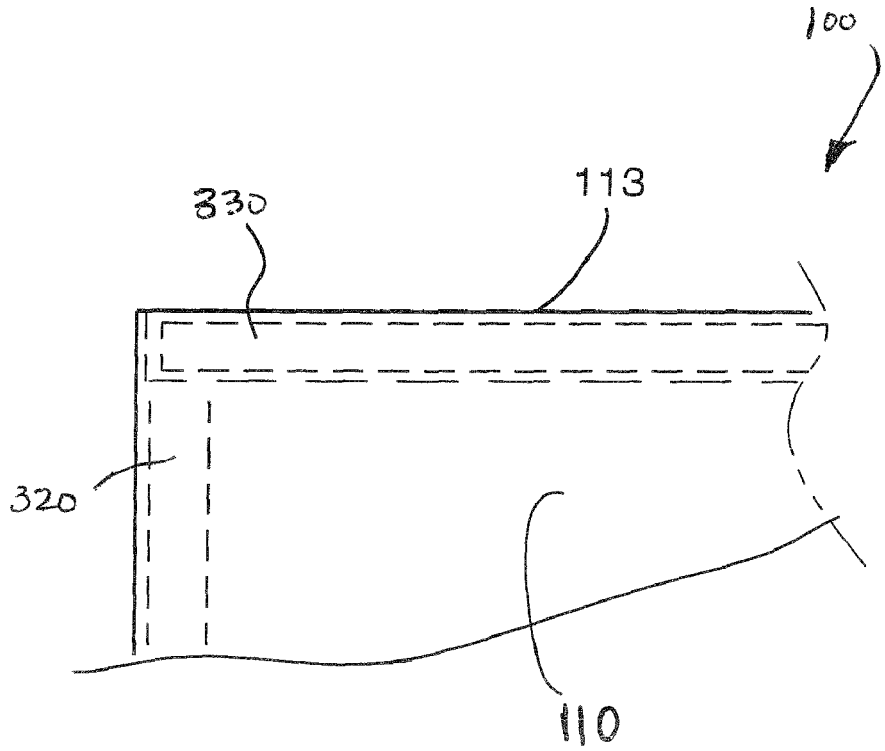
FIG. 2 is a front and internal view of the fireplace cover of FIG. 1.
Figure 3:
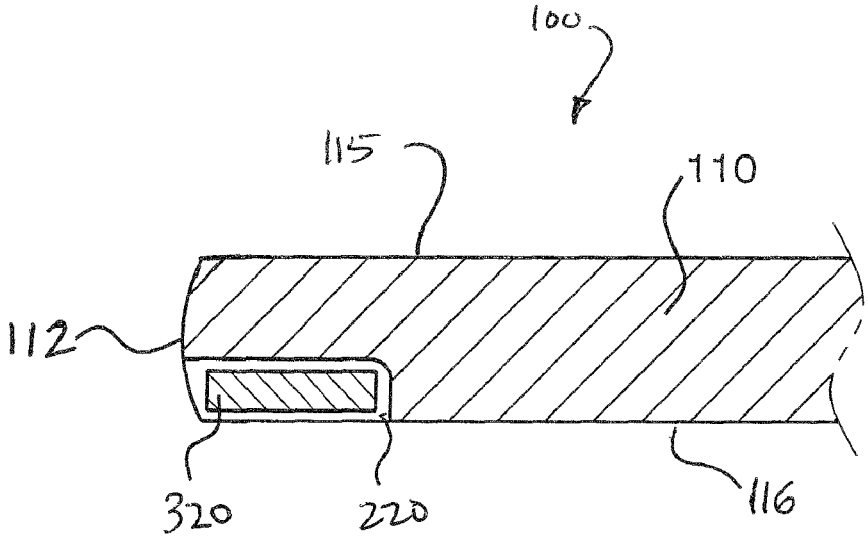
FIG. 3 is a top cross sectional view of the panel.

330 third magnetic bar
340 fourth magnetic bar
540 metal trim
545 flat sheet metal
560 edge of fireplace
565 floor of fireplace Referring now to FIGS. 1-3, the present invention features a fireplace cover 100 for covering a fireplace 105. In some embodiments, the fireplace cover 100 of the present invention may be used as a means of decorating a fireplace 105. Without wishing to limit the present invention to any theory or mechanism, it is believed that the fireplace cover 100 of the present invention is advantageous because it helps to seal a fireplace so that air is not leaked out of or in from the fireplace, which helps to improve energy efficiency.

The fireplace cover 100 comprises a generally flat and flexible panel 110 having a first side edge 111, a second side edge 112, a top edge 113, a bottom edge 114, a front surface 115, and a back surface 116.

Disposed in the panel 110 along the first side edge 111 is a first slot 210 having a first end 211 and a second end 212. The first end 211 is near the top edge 113 of the panel 110 and the second end 212 is near the bottom edge 114 of the panel 110. Disposed in the panel 110 along the second side edge 112 is a second slot 220 having a first end 221 and a second end 222. The first end 221 is near the top edge 113 of the panel 110 and the second end 222 is near the bottom edge 114 of the panel 110. The first end 211 of the first slot 210 and the first end 221 of the second slot 220 are open. The second end 212 of the first slot 210 and the second end 222 of the second slot 220 are closed, for example via a stitch.

Disposed in the panel 110 along the top edge 113 is a third slot 230 having a first end 231 and a second end 232. The first end 231 is near the first side edge 111 of the panel 110 and the second end 232 is near the second side edge 112 of the panel 110. Disposed in the panel 110 along the bottom 114 is a fourth slot 240 having a first end 241 and a second end 242. The first end 241 is near the first side edge 111 of the panel 110 and the second end 242 is near the second side edge 112 of the panel 110. The first end 231 of the third slot 230, the second end 232 of the third slot 230, the first end 241 of the fourth slot 240, and the second end 242 of the fourth slot 240 are closed, for example via a stitch.

Disposed in the first slot 210 is a first magnetic bar 310 and disposed in the second slot 220 is a second magnetic bar 320. The first magnetic bar 310 and the second magnetic bar 320 are removable. For example, a user can slide the first magnetic bar 310 in and out of the first slot 210 via the open first end 211 of the first slot 210. A third magnetic bar 330 is disposed in the third slot 230 and a fourth magnetic bar is disposed in the fourth slot 240.

Figure 4A:
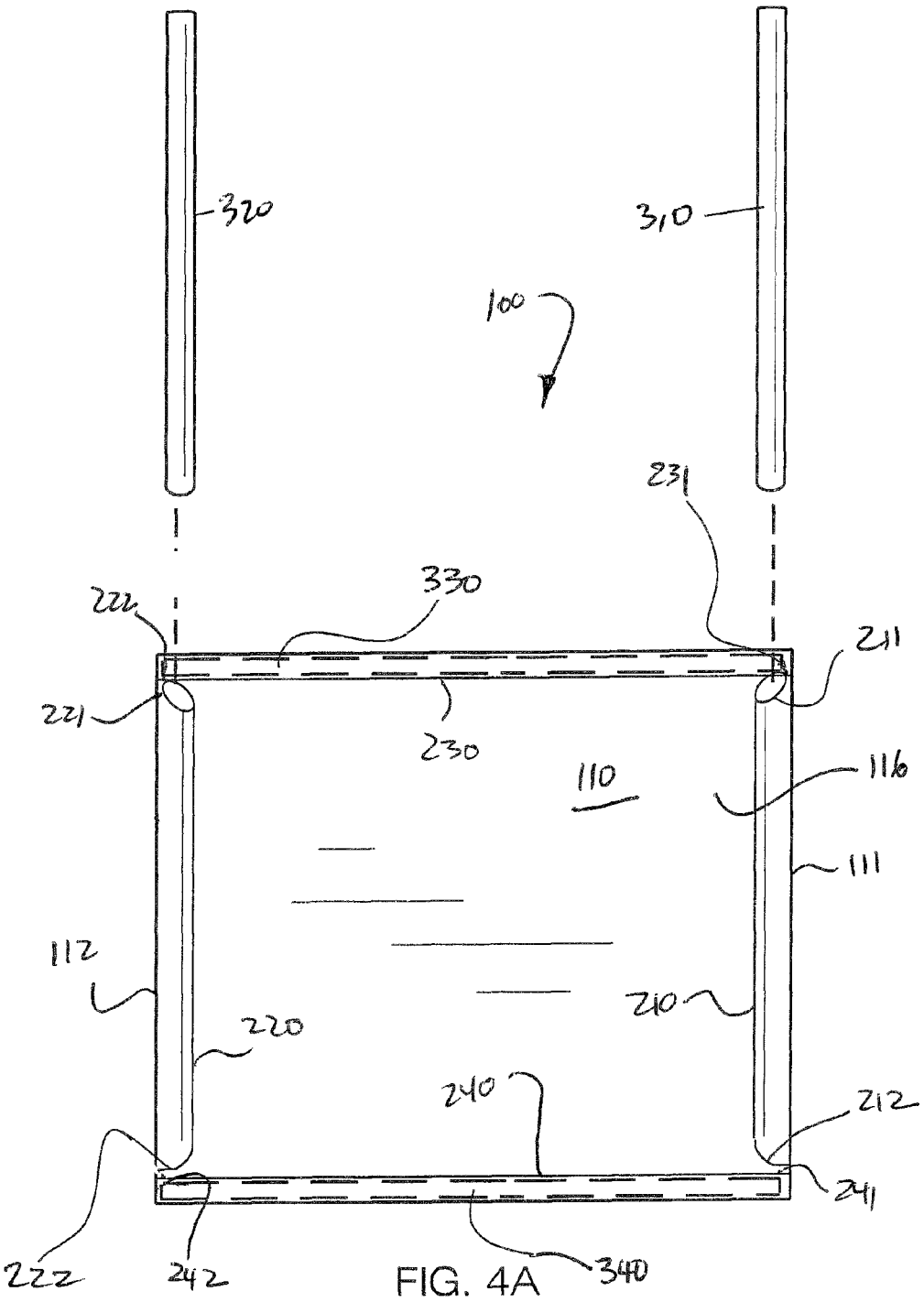
FIG. 4A is a back view of the fireplace cover of the present invention.
Figure 4B:
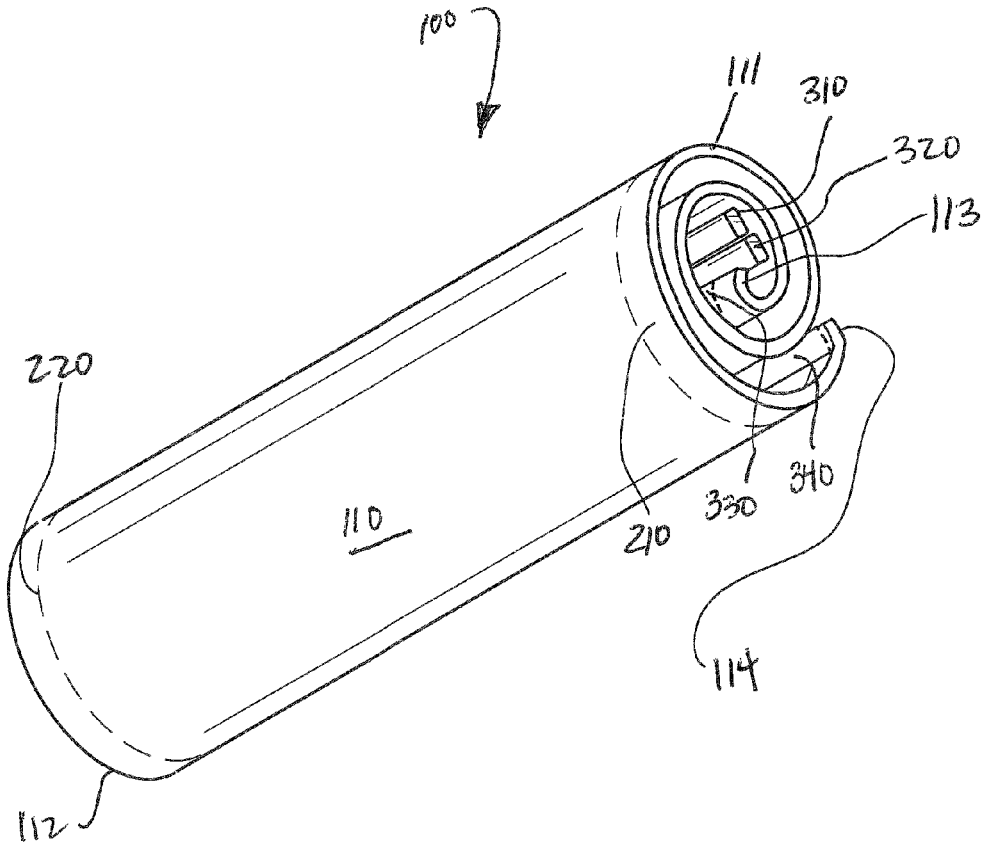
FIG. 4B is a perspective view of the fireplace cover of the present invention, wherein the panel is rolled for storage purposes.

The removable first magnetic bar 310 and second magnetic bar 320 allow a user to roll or fold the panel 110 when it is not in use, for example for storage purposes (see FIG. 4B). For example, if the first magnetic bar 310 and the second magnetic bar 320 are permanently attached in the panel 110, it may be difficult to roll or fold the panel 110 into a compact configuration for storage.

As shown in FIG. 3, the magnetic bars are generally flat. In some embodiments, the magnetic bars are oriented toward the back surface 116 of the panel 110. For example, the second magnetic bar 320 disposed in the second slot 220 is oriented at the corner of the second side edge 112 of the panel 110 and the back surface 116 of the panel. This orientation can help to promote an air-tight seal between the fireplace cover 100 and the fireplace 105.

Figure 5:
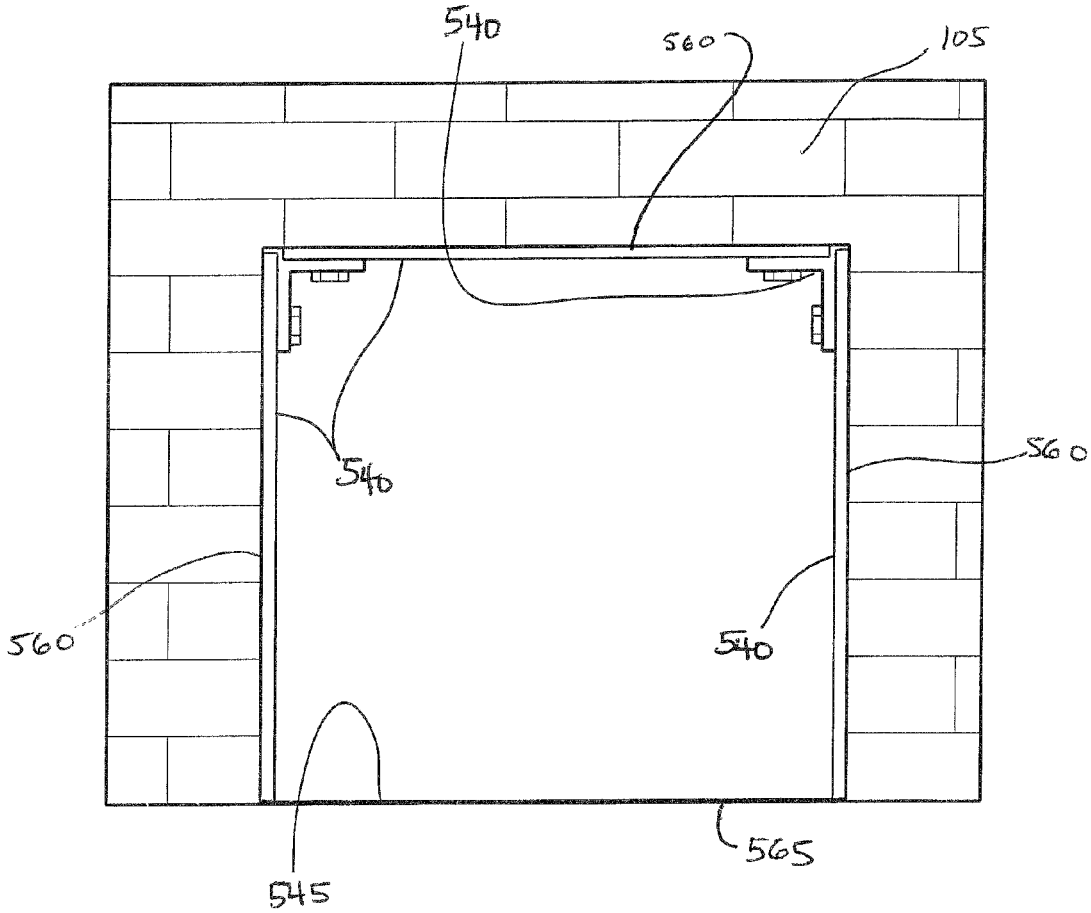
FIG. 5 is a front view of a fireplace having metal trim on the edges of the fireplace and a flat sheet metal on the floor of the fireplace.

To user the fireplace cover 100 of the present invention, a user inserts the first magnetic bar 310 into the first slot 210 via the first end 211 of the first slot 210. Next, he/she insets the second magnetic bar 320 into the second slot 220 via the first end 221 of the second slot 220. Next, the user mounts the fireplace cover 100 over the edges of a fireplace 105 by allowing the magnetic bars to bind to the metal frame on the edge of the fireplace 105. If a metal frame is not present on the edge of a fireplace 105, a user can install metal trim 540 around the fireplace edges 560, and then the fireplace cover 100 of the present invention can be attached to the metal trim 540. In some embodiments, a piece of flat sheet metal 545 can be placed in the floor 565 of the fireplace 105 (see FIG. 5).

In some embodiments, the first magnetic bar 310, second magnetic bar 320, third magnetic bar 330, and fourth magnetic bar 340 allow for an air-tight seal between the edges 560 of the fireplace 105 and the panel 110 of the fireplace cover 100.

The present invention also comprises a kit comprising the aforementioned fireplace cover 100. For example, the kit may comprise a panel 110 and a plurality of magnetic bars for inserting into the first slot 210 at the first side edge 111 of the panel 110 and the second slot 220 at the second side edge 112 of the panel 110.

The present invention also features a method of decorating a fireplace 105. The method comprises providing the aforementioned fireplace cover 100 and attaching the fireplace cover 100 to the edges of a fireplace 105 so that air does not leak into or out of the fireplace 105.

The fireplace cover 100 may be constructed from a variety of materials. In some embodiments, the panel 110 is constructed from a material comprising a fire-resistant material. In some embodiments, the panel 110 is constructed from a material comprising a vinyl, a nylon, a polyvinyl, a fiberglass, the like, or a combination thereof. In some embodiments, the panel 110 is constructed from a material similar to a material used to cover an outdoor grill, and such material is well known to one of ordinary skill in the art. In some embodiments, the front surface 115 and the back surface 116 of the panel 110 is smooth and does not comprise fiberglass backing. In some embodiments, the panel 110 is amenable to being easily decorated with a design.

The fireplace cover 100 of the present invention may be constructed in a variety of sizes to accommodate fireplaces of various sizes. The fireplace cover 100 of the present invention may be decorated with various designs.

The first magnetic bar 310, second magnetic bar 320, third magnetic bar 330, and fourth magnetic bar 340 are similar in size and shape to magnets found in refrigerator and/or freezer doors. Such magnets are well known to one of ordinary skill in the art.

In some embodiments, the magnetic bars have a top surface, a bottom surface, a first side edge, a second side edge, a third side edge, and a fourth side edge. In some embodiments, the magnetic bars are between about ⅛ inch and ¼ inch in thickness as measured from the top surface to the bottom surface.

In some embodiments, the magnetic bars are between about 0.1 to 0.5 inches in width, as measured from the first side edge to the second side edge. In some embodiments, the magnetic bars are between about 0.5 and 1.0 inches in width (e.g., 0.5/8 inch). In some embodiments, the magnetic bars are between about 1.0 and 5.0 inches in width. In some embodiments, the magnetic bars are more than about 5.0 inches in width.

In some embodiments, the first side edges and second side edges of the magnetic bars are rounded. In some embodiments, the third side edges and fourth side edges of the magnetic bars are rounded. The rounded edges may help the magnetic bars slide in and out of the slots.

As used herein, the term "about" refers to plus or minus 10% of the referenced number. For example, an embodiment wherein the first magnetic bar 310 is about 1.0 inches thick includes a first magnetic bar 310 that is between 0.9 and 1.1 inches thick.

The following the disclosures of the following U.S. patents are incorporated in their entirety by reference herein: U.S. Pat. No. 4,072,140; U.S. Pat. No. 6,073,625; U.S. Pat. No. 5,301,655; U.S. Pat. No. 6,748,943; U.S. Pat. No. 3,894,527

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A fireplace cover system comprising:

(a) a metal frame disposed adjacent to at least a top edge and two opposing side edges of a fireplace opening;

(b) a first magnetic bar, a second magnetic bar, a third magnetic bar, and a fourth magnetic bar;

(c) a generally flat and flexible panel having a first side edge, a second side edge, a top edge, and a bottom edge;

(d) a first slot disposed in the panel along the first side edge, wherein a first end of the first slot is permanently open and a second end of the first slot is permanently closed; wherein the first magnetic bar is removably disposed in the first slot;

(e) a second slot disposed in the panel along the second side edge, wherein a first end of the second slot is permanently open and a second end of the second slot is permanently closed; wherein the second magnetic bar is removably disposed in the second slot;

(f) a third slot disposed in the panel along the top edge, wherein a first end of the third slot is permanently closed and a second end of the third slot is permanently closed; wherein the third magnetic bar is permanently disposed in the third slot; and (g) a fourth slot disposed in the panel along the bottom edge, wherein a first end of the fourth slot is permanently closed and a second end of the fourth slot is permanently closed; wherein the fourth magnetic bar is permanently disposed in the fourth slot;

wherein each of the magnetic bars comprises a first side edge, a second side edge, a third side edge and a fourth side edge, wherein the first side edge, the second side edge, the third side edge, and the fourth side edge of the first magnetic bar, the second magnetic bar, the third magnetic bar, and the fourth magnetic bar are rounded to help the magnetic bars slide in and out of the slots, wherein the first magnetic bar, the second magnetic bar, the third magnetic bar, and the fourth magnetic bar are generally flat;

wherein the fireplace cover system is for covering a fireplace, wherein the first magnetic bar is inserted into the first slot via the first end of the first slot, wherein the second magnetic bar is inserted into the second slot via the first end of the second slot, wherein the fireplace panel is magnetically and sealably connected to the metal frame of the fireplace.

2. The fireplace cover system of claim 1, wherein the panel is constructed from a material comprising a fire-resistant material.

3. The fireplace cover system of claim 1, wherein the panel is constructed from a material comprising a vinyl, a nylon, a polyvinyl, a fiberglass, or a combination thereof.

* * * * *